US009328471B2

(12) United States Patent
Splittstoesser

(10) Patent No.: US 9,328,471 B2
(45) Date of Patent: May 3, 2016

(54) SAFEGUARDING ARRANGEMENT FOR COLLECTING A FLUID ESCAPING INTO A BODY OF WATER

(76) Inventor: Wulf Splittstoesser, Kelkheim/Ts. (DE)

( * ) Notice: Subject to any disclaimer, the term of this patent is extended or adjusted under 35 U.S.C. 154(b) by 0 days.

(21) Appl. No.: 13/807,416

(22) PCT Filed: Jul. 8, 2011

(86) PCT No.: PCT/EP2011/061656

§ 371 (c)(1),
(2), (4) Date: Dec. 28, 2012

(87) PCT Pub. No.: WO2012/007389

PCT Pub. Date: Jan. 19, 2012

(65) Prior Publication Data

US 2013/0108369 A1 May 2, 2013

(30) Foreign Application Priority Data

Jul. 13, 2010 (DE) ..... 10 2010 027 062
Nov. 15, 2010 (DE) ..... 10 2010 051 164

(51) Int. Cl.
*E02B 15/04* (2006.01)
*E02B 15/08* (2006.01)
*E21B 43/01* (2006.01)

(52) U.S. Cl.
CPC ..... *E02B 15/0807* (2013.01); *E21B 43/0122* (2013.01)

(58) Field of Classification Search
USPC ..... 405/60, 63, 64, 68, 69, 210; 166/363, 166/364
See application file for complete search history.

(56) References Cited

U.S. PATENT DOCUMENTS

| | | | | |
|---|---|---|---|---|
| 4,395,157 | A * | 7/1983 | Cunningham | 405/60 |
| 5,749,676 | A * | 5/1998 | Head | 405/171 |
| 6,341,920 | B1 * | 1/2002 | Bremnes | 405/63 |
| 6,517,290 | B1 * | 2/2003 | Poldervaart | 405/224.2 |
| 6,592,299 | B1 | 7/2003 | Becker | |

FOREIGN PATENT DOCUMENTS

| | | | |
|---|---|---|---|
| FR | 2 804 935 | A1 | 8/2001 |
| FR | 2804935 | * | 8/2001 |
| FR | 2 850 425 | A1 | 7/2004 |
| FR | 2 853 673 | A1 | 10/2004 |

(Continued)

OTHER PUBLICATIONS http://www.thefreedictionary.com/navigable.*

(Continued)

*Primary Examiner* — Sean Andrish
(74) *Attorney, Agent, or Firm* — Harness, Dickey & Pierce, P.L.C.

(57) ABSTRACT

The invention relates to a protective device for preventing fluids, either gaseous or liquid, from escaping into a body of water in an unforeseen or uncontrolled manner, e.g. from a fault 14 in the bottom 15 of the body of water or from the defective riser 16 of a wellbore. The protective device has a dome-shaped membrane 12 that is impervious to the fluid. Further, it has individually navigable flotation devices 17 that are attached to the membrane 12 for the purpose of positioning and stabilizing the membrane 12. An outlet hose 102 for extracting the fluid is mounted on the membrane. The outlet hose also has individually navigable flotation devices 17 for positioning and stabilizing the outlet hose.

13 Claims, 2 Drawing Sheets

(56) References Cited

FOREIGN PATENT DOCUMENTS

| | | | | |
|---|---|---|---|---|
| GB | 2 066 095 | A | | 7/1981 |
| GB | 2 071 020 | A | | 9/1981 |
| JP | 2008-100536 | | * | 1/2008 |
| RU | 2127787 | C1 | | 3/1999 |

OTHER PUBLICATIONS

English translation of the IPRP dated Jan. 17, 2013.
International Search Report for PCT/EP2011/061656, mailed Apr. 27, 2012; ISA/EP.

* cited by examiner

SAFEGUARDING ARRANGEMENT FOR COLLECTING A FLUID ESCAPING INTO A BODY OF WATER

CROSS-REFERENCE TO RELATED APPLICATIONS

This application is a 371 U.S. National Stage of International Application No. PCT/EP2011/061656, filed on Jul. 8, 2011, which claims priority to German Patent Application No. 10 2010 027 062.8, filed on Jul. 13, 2010 and German Patent Application No. 10 2010 051 164.1, filed on Nov. 15, 2010. The contents of the above applications are incorporated herein by reference in their entirety.

BACKGROUND OF THE INVENTION

1. Field of the Invention

The invention relates to a protective device for preventing fluids, whether gaseous or liquid, from escaping into a body of water in an uncontrolled manner, e.g. from a fault in the bottom of the body of water or from the defective riser of a wellbore.

2. Prior Art

Blowout preventers (BOP) are shut-off valves that are fitted directly over the wellbore. At present, blowout preventers are used, in the case of damage to the exploitation equipment, to prevent the emerging fluid from reaching the environment in an uncontrolled manner.

The catastrophe in the Gulf of Mexico shows, however, that there does not yet exist any rapidly deployable, working mechanism to effectively prevent the uncontrolled outflow of gases and liquids, or to control escaping fluids.

The loss of the fluid, on the one hand, and on the other hand, much more important here, the contamination of the environment with the resulting hazards and damage, prove to be disadvantageous.

3. Object

The invention is based on the object of collecting a fluid that is flowing into a body of water or suspended in a body of water and that has a density equal to or less than the density of the water, separating it from the water and delivering it for further processing or disposal. Such fluids are, for example, oil or gas that is escaping from or that has escaped from a wellbore.

BRIEF SUMMARY OF THE INVENTION

This object is achieved by a protective device for collecting a fluid escaping into a body of water. The density of the fluid is equal to or less than the density of water. The protective device comprises a dome-shaped membrane that is impervious to the fluid, individually navigable flotation devices that are attached to the membrane for the purpose of positioning and stabilizing the membrane, at least one outlet hose for extracting the fluid, and individually navigable flotation devices that are attached to the at least one outlet hose for the purpose of positioning and stabilizing the at least one outlet hose. A first end of the at least one outlet hose is attached to the membrane. The at least one outlet hose consists of a plurality of hose segments coupled to one another. The at least one outlet hose has at least one non-return valve. The at least one non-return valve closes as soon as the flow velocity of the fluid flowing out of the membrane through the at least one outlet hose exceeds a threshold value or the fluid flows into the membrane through the at least one outlet hose. The membrane has at least one opening in order to allow at least one of fish and submersibles to pass. The protective device comprises a surface station for intermediately storing and pumping off the fluid. A second end of the at least one outlet hose is attached to the surface station. The surface station has a dome-shaped tank for collecting the fluid.

The protective device for collecting a fluid escaping into a body of water according to the invention comprises a possibly dome-shaped membrane, composed of a suitable material such as, for instance, film or fabric, that is impervious to the fluid. The membrane can be produced, for example, from a plastic film that, for its part, can be provided with, for example, a vapour-deposited metal layer as protection against destruction by the fluid. Alternatively the membrane can be composed, for example, of a metal braided fabric that is sealed by a plastic coating.

A suitable material is a flexible material that is resistant to the fluid, i.e. whose physical properties do not alter upon contact with the fluid. It is also possible to use textile material, e.g. carbon fibres or a metal braided fabric, which is coated with a suitable substance for the purpose of sealing, possibly with a plastic, a plant-based polymer or a biopolymer. Also suitable are certain plastic films, or films composed of a plant-based polymer, and possibly biopolymers.

The shape of the membrane and its size are preferably adapted to the necessary conditions through mechanisms such as, for example, reef lines, button mechanisms, zip fasteners, or correspondingly automatically controlled cables.

An object such as, for instance, the membrane, is generally referred to as dome-shaped if the surfaces of the object each constitute a surface of a portion of a convex body. A portion of a body is to be understood as a partial body whose points all lie on the same side of an unbounded surface, for example a plane. Thus, a flattened dome is a portion of a body of revolution that has been produced from a conic section. A spherical dome is a portion of a sphere. Preferably, the membrane has the shape of a flattened dome or of a portion of a convex polyhedron.

For the purpose of positioning and stabilizing the membrane, flotation devices are preferably attached to the membrane. These flotation devices can be navigated individually, i.e. each per se, in all directions. The positioning of the flotation devices can be effected either automatically, i.e. in a program-controlled manner, or by remote control. Remotely operated vehicles (ROV) or autonomous underwater vehicles (AUV) are suitable for use as flotation devices according to the invention.

The use of a thin, flexible membrane that is only held by the flotation devices enables protective devices according to the invention to be realized in almost any size. In particular, membranes of very large dimensions are rendered possible.

Downwardly, the membrane can terminate with a lip that is or can be correspondingly shaped. Instead of the flotation devices, weights, i.e. elements whose density exceeds the density of water, can be attached to the lip. Preferably, however, the membrane floats freely in a predetermined depth, positioning of the membrane being effected exclusively by the flotation devices.

The membrane is preferably let into the body of water in the folded state. If fluids that are suspended in the body of water and whose density is equal to the density of water are to be collected, the flotation devices preferably unfold the membrane over the suspended fluids. After this, the membrane is lowered. As a result, the suspended fluids are enclosed by the membrane and thereby collected.

If the fluid flows out of a source, for instance a leaking wellbore, into the body of water, and if the density of the fluid is less than the density of water, the flotation devices preferably position the membrane over the source in its folded state. Rising fluid then meets the membrane and flows into the membrane. Consequently, the membrane unfolds due to the buoyancy of the fluid.

In order to facilitate the handling, i.e. the navigation, the positioning and the stabilization of the membrane by the flotation devices, the density of the membrane is preferably equal to or less than the density of water. This can result from the manner of production or can be achieved through a corresponding specific weight or, possibly, through corresponding gas or solid inclusions.

In the case of very large volumes, the wall can be composed of components that are produced differently in respect of the specific weight, depending on depth. In other words: the membrane consists of at least two segments with differing densities. In this case, the density of a first of the at least two segments is preferably less than the density of a second of the at least two segments if the first of the at least two segments, or its centre of buoyancy, is disposed higher up in respect of the water surface, i.e. closer to the water surface, than the second of the at least two segments, or its centre of buoyancy. Consequently, segments that are disposed higher up generate greater buoyancy than segments that are disposed lower down. This simplifies the positioning of the membrane by the weights and/or flotation devices.

In order to ensure proper functioning of the protective device, the installation of sensors and/or monitoring cameras is provided. It has proved advantageous for the flotation devices also to be equipped with cameras.

One or more outlet hoses are attached to the membrane. Via these hoses, the fluid is extracted in the direction of the water surface. If the density of the fluid is less than the density of water, a pump is not required for this purpose. A valve at the interface between the outlet hose and the membrane prevents an uncontrolled outflow of the fluid. The valve may be remote-controlled. Alternatively, the valve may be actuated automatically, controlled by level sensors.

The outlet hose should be composed of a flexible material whose density is preferably equal to or less than the density of water. This can prevent the membrane from being damaged by the outlet hose. Furthermore, the positioning and stabilization of the outlet hose are simplified.

For the purpose of positioning and stabilizing the outlet hose, flotation devices of the type described above (thus, individually navigable) are attached to the outlet hose.

Depending on the depth of the body of water, an outlet hose of differing length is required. Preferably, therefore, the outlet hose consists of a plurality of hose segments coupled to one another.

In the case of damage to the outlet hose, there is the risk of the extracted fluid flowing from the damaged location into the body of water. This is prevented, in a preferred embodiment of the invention, by at least one non-return valve, which is disposed in the outlet hose such that it can hold back fluid flowing in the direction of the water surface from the membrane. In the case of damage to the outlet hose, the flow velocity of the fluid flowing out of the membrane through the outlet hose increases, or the direction of its flow alters. As soon as the flow velocity has exceeded a threshold value, or there is a reversal of the direction of flow, the non-return valve closes. If the flow velocity is below the threshold value, on the other hand, the non-return valve is open.

In order to achieve this, on the one hand, an ordinary mechanical non-return valve can be installed in one flow direction. On the other hand, a non-return valve that is biased by a spring, and that can withstand the flow of the fluid only up to a certain flow velocity, can be installed counter to the flow direction. The spring bias can keep the valve open only up to this flow velocity, after which the valve is closed by the flow, or by the pressure counter to the spring bias associated therewith.

For fish and, in the case of a corresponding size of the membrane, also for submersibles present inside the membrane, the incoming fluid constitutes a hazard. A preferred embodiment of the invention of the protective device therefore has openings, so-called fish gates or boat gates, through which the fish and/or submersibles can escape from the membrane into the body of water.

The fish gates or boat gates may be implemented as closable gaps in the membrane that are inclined in the direction of the bottom of the body of water. Because of the inclination of the fish gates or boat gates, fluid flowing into the membrane is routed past the fish gates or boat gates. Consequently, as long as the level of the fluid present within the membrane remains above the fish gates or boat gates, scarcely any fluid can escape through the fish gates or boat gates into the body of water. If so much fluid accumulates within the membrane that the level of the fluid sinks as far as the fish gates or boat gates, the fish gates or boat gates are closed.

Alternatively, the fish gates or boat gates are each implemented as a nozzle. The first of two openings of the nozzle is connected to the membrane along the edge of a gap in the membrane. Preferably, the nozzle is composed of the same material as the membrane. Annular reinforcements along the nozzle prevent the nozzle from collapsing.

For the purpose of positioning and stabilizing the nozzle, flotation devices of the type described above are attached to the nozzle. In order that no fluid can escape from the nozzle, the flotation devices align the nozzle such that the second of the two openings of the nozzle, which faces in the direction of the body of water, is located beneath the level of the fluid present inside the membrane.

The fish gates or boat gates can additionally serve to compensate for currents acting upon the membrane.

In a preferred embodiment of the invention, a second end of the outlet hose is attached to a surface station for intermediately storing and pumping off the fluid. In order that the load on the surface station resulting from the weight of the outlet hose is as small as possible, the density of the outlet hose should be equal to or less than the density of water.

It has proved advantageous that the surface station is not fixed, for instance by anchoring on the bottom of the body of water. Instead, the surface station floats freely on the water surface, and can therefore follow the movements of the membrane, which is likewise free-floating. Preferably, the surface station has one or more controllable or navigable drive units for positioning and stabilization. For protection against damage resulting from adverse weather, or for protection against military attacks, the surface station, together with an associated tank, may also be held at a predetermined depth under water by corresponding flotation devices and counter-balance devices.

The fluid emerging from the outlet hose in the surface station is preferably collected in a dome-shaped tank belonging to the surface station, the tank being for instance in the manner of cantilevered hangars, or held in such a hangar by corresponding devices. In this case, the lower opening of the tank is located on or beneath the water surface. Fluid entering the tank therefore floats on the water surface within the tank. In this way, aqueous components possibly contained in the fluid are separated from the fluid without the use of specific resources, and are returned to the body of water.

Convection of the fluid into the water can occur at the interface between the fluid and the water. A barrier layer between the fluid and the water preferably prevents this effect. This barrier layer may be constituted by a liquid that is filled into the tank and whose density is greater than the density of the fluid and less than the density of water. It can also be implemented as a membrane composed of appropriate material—of film or of textile material.

In order to prevent a large quantity of fluid from emerging in an uncontrolled manner in the case of damage to the surface station, the tank is preferably divided into a plurality of sections.

BRIEF DESCRIPTION OF THE DRAWINGS

Further details and features are disclosed by the following description of preferred embodiments in combination with the dependent claims. Each of the features in this case can be implemented singly per se, or multiply, in combination with one another. The possibilities for achieving the object are not limited to the exemplary embodiments.

The exemplary embodiments are represented schematically in the figures. Identical reference numerals in the individual figures denote elements that are identical or that have the same function, or that correspond to one another in respect of their functions. In detail.

DETAILED DESCRIPTION OF THE INVENTION

Figure 1:
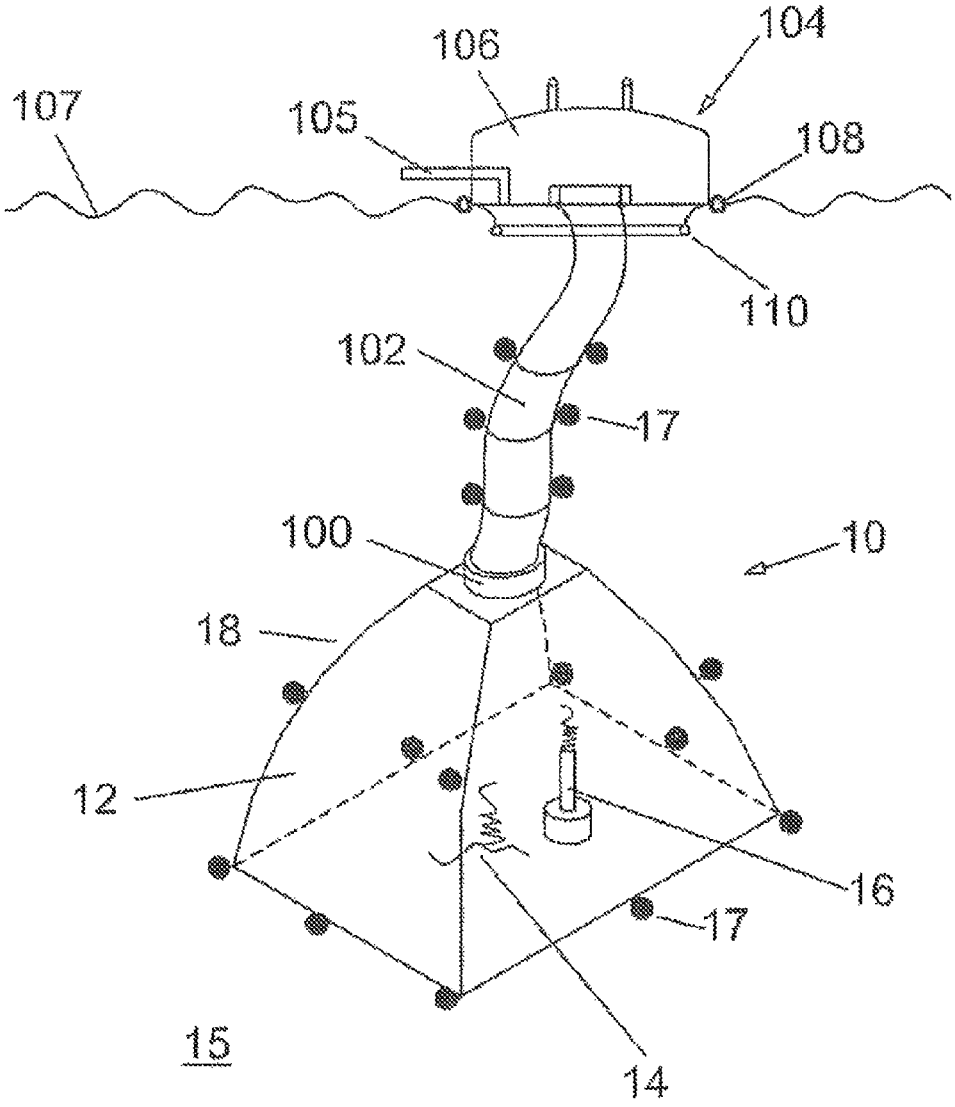
FIG. 1 shows a protective device according to the invention, having an outlet hose and a surface station.

Represented in FIG. 1 is a protective device 10 whose membrane 12 has been unfolded over a fault 14 in the bottom 15 of the body of water from which a fluid is emerging, or over a defective riser 16 from which a fluid is emerging. The individually navigable flotation devices 17 position the membrane 12 such that it is located over the fault 14, or over the defective riser 16. If the density of the fluid is less than the density of water, the fluid rises and accumulates in the membrane 12.

In order to render the membrane 12 resistant to the uplift forces of the fluid and to sea currents, it is provided with reinforcing struts 18. The reinforcing struts 18 can also be composed, for example, of glass-fibre reinforced plastic or of a fibrous composite material. The membrane 12 can likewise be stabilized by pressure lines.

An adapter block 100, which is attached to the highest point of the membrane 12, couples the membrane 12 to the outlet hose 102. The adapter block 100 has valves and control mechanisms, as well as necessary measuring and regulating equipment. Flotation devices (not shown) position the adapter block 100. Cameras and sensors control the state and the functioning of the adapter block 100.

Likewise, individually navigable flotation devices 17 hold the outlet hose 102 in position.

A valve 103 in the adapter block 100 releases the fluid accumulated inside the membrane 12, if required. As a result, this fluid flows through the outlet hose 102 into the surface station 104. Here, the fluid is collected in the dome-shaped tank 106. The latter can be produced from suitable materials, from film or textile material, but also, for example, from solid materials such as steel.

At the surface station 104 there are all the necessary technical connectors 105 for connecting to tanker ships, for environmentally appropriate disposal or for direct further processing of the fluid.

The surface station 104 floats freely on the water surface 107, such that water can enter the tank 106 from below. The fluid floats on the water, inside the tank 106. Above the fluid, likewise in the tank 106, there is air.

The buoyancy of the surface station 104 can be counterbalanced through alteration of the volume of air. Alternatively, the surface station 104 has one or more floats 108.

A full-perimeter anchor lip 110 encloses the opening of the tank 106. The anchor lip 110 prevents the fluid from escaping laterally.

Figure 2:
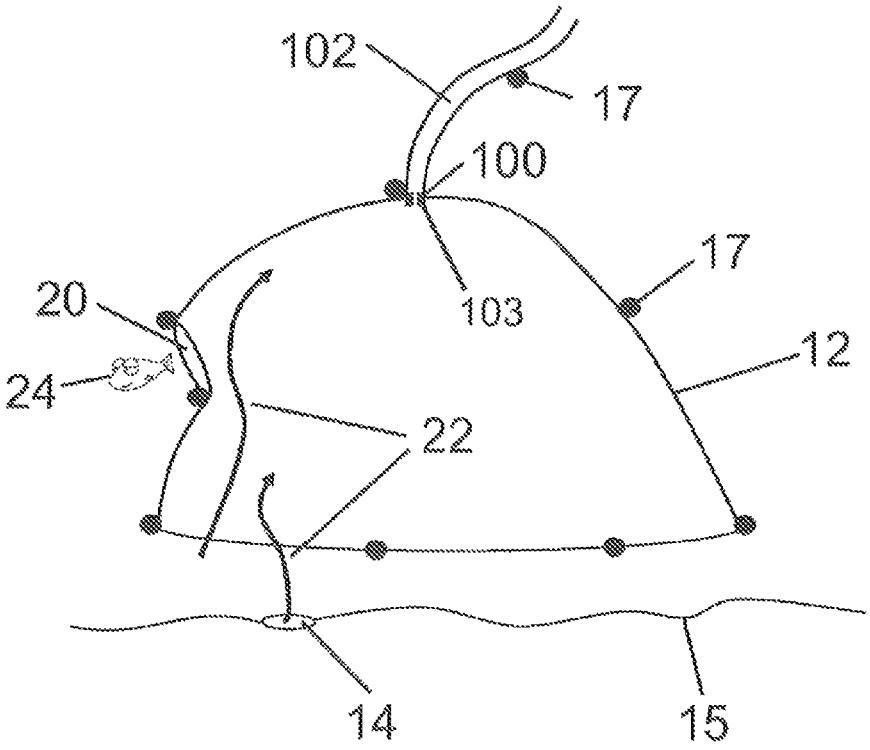
FIG. 2 shows a protective device according to the invention, having a fish gate.

The membrane 12 represented in FIG. 2 has a fish gate 20—a closable opening inclined in the direction of the bottom 15 of the body of water. The inclination of the fish gate 20 prevents the fluid 22 flowing out of the fault 14 in the bottom 15 of the body of water from escaping into the body of water, as long as the amount of fluid in the membrane is still sufficiently low. By contrast, fish 24 can leave the membrane 12 through the fish gate 20.

The invention claimed is:

1. A protective device for collecting a fluid escaping into a body of water, wherein the density of the fluid is equal to or less than the density of water, wherein the protective device comprises a) a dome-shaped membrane that is impervious to the fluid;

b) individually navigable flotation devices that are attached to the membrane for the purpose of positioning and stabilizing the membrane;

c) at least one outlet hose for extracting the fluid, a first end of the at least one outlet hose being attached to the membrane; and d) individually navigable flotation devices that are attached to the at least one outlet hose for the purpose of positioning and stabilizing the at least one outlet hose;

e) wherein the individually navigable flotation devices that are attached to the membrane are comprised of at least one of a remotely operated vehicle and an autonomous underwater vehicle and are navigable in all directions by remote control.

2. The protective device according to claim 1, wherein the at least one outlet hose consists of a plurality of hose segments coupled to one another.

3. The protective device according to claim 1, wherein the at least one outlet hose has at least one non-return valve, the at least one non-return valve closing as soon as the flow velocity of the fluid flowing out of the membrane through the at least one outlet hose exceeds a threshold value or the fluid flows into the membrane through the at least one outlet hose.

4. The protective device according to claim 1, wherein the membrane has at least one opening in order to allow at least one of fish and submersibles to pass.

5. The protective device according to claim 1, wherein the protective device comprises a surface station for intermediately storing and pumping off the fluid, a second end of the at least one outlet hose being attached to the surface station.

6. The protective device according to claim 5, wherein the surface station has a dome-shaped tank for collecting the fluid.

7. A protective device for collecting a fluid escaping into a body of water, wherein the density of the fluid is equal to or less than the density of water, wherein the protective device comprises a) a dome-shaped membrane that is impervious to the fluid;

b) individually navigable flotation devices that are attached to the membrane for the purpose of positioning and stabilizing the membrane;

c) at least one outlet hose for extracting the fluid, a first end of the at least one outlet hose being attached to the membrane; and d) individually navigable flotation devices that are attached to the at least one outlet hose for the purpose of positioning and stabilizing the at least one outlet hose;

e) wherein the individually navigable flotation devices that are attached to the membrane are comprised of at least one of a remotely operated vehicle and an autonomous underwater vehicle and are automatically navigable in all directions.

8. The protective device according to claim 7, wherein the at least one outlet hose consists of a plurality of hose segments coupled to one another.

9. The protective device according to claim 7, wherein the at least one outlet hose has at least one non-return valve, the at least one non-return valve closing as soon as the flow velocity of the fluid flowing out of the membrane through the at least one outlet hose exceeds a threshold value or the fluid flows into the membrane through the at least one outlet hose.

10. The protective device according to claim 7, wherein the membrane has at least one opening in order to allow at least one of fish and submersibles to pass.

11. The protective device according to claim 7, wherein the protective device comprises a surface station for intermediately storing and pumping off the fluid, a second end of the at least one outlet hose being attached to the surface station.

12. The protective device according to claim 11, wherein the surface station has a dome-shaped tank for collecting the fluid.

13. The protective device of claim 7, wherein the individually navigable flotation devices that are attached to the membrane are automatically navigable in all directions in a program-controlled manner.

* * * * *